US007198557B2

(12) United States Patent
Haney

(10) Patent No.: US 7,198,557 B2
(45) Date of Patent: Apr. 3, 2007

(54) SANDING MACHINE INCORPORATING MULTIPLE SANDING MOTIONS

(76) Inventor: Donald E. Haney, 4071 Galls Creek Rd., Gold Hill, OR (US) 97525

( * ) Notice: Subject to any disclaimer, the term of this patent is extended or adjusted under 35 U.S.C. 154(b) by 356 days.

(21) Appl. No.: 10/211,927

(22) Filed: Aug. 2, 2002

(65) Prior Publication Data

US 2003/0124961 A1 Jul. 3, 2003

Related U.S. Application Data

(60) Provisional application No. 60/309,948, filed on Aug. 2, 2001.

(51) Int. Cl.
*B24B 7/06* (2006.01)
*B24B 7/28* (2006.01)

(52) U.S. Cl. ..... 451/184; 451/130

(58) Field of Classification Search ..... 451/120, 451/127, 130, 131, 178, 182, 184
See application file for complete search history.

(56) References Cited

U.S. PATENT DOCUMENTS

| | | | |
|---|---|---|---|
| 67,240 | A | 7/1867 | Weissenborn |
| 296,585 | A | 4/1884 | Laughton |
| 346,680 | A | 8/1886 | Perry |
| 449,689 | A | 4/1891 | Malevez |
| 496,052 | A | 4/1893 | Friedel |
| 513,618 | A | 1/1894 | Oppermann |
| 577,582 | A | 2/1897 | Lane et al. |
| 676,487 | A | 6/1901 | Brown |
| 714,899 | A | 12/1902 | Hayes |
| 1,027,558 | A | 5/1912 | Meyers |
| 1,143,725 | A | 6/1915 | Reed |
| 1,166,640 | A | 1/1916 | Shaw |
| 1,233,120 | A | 7/1917 | Patch |
| 1,494,895 | A | 5/1924 | Foldessy |
| 1,909,902 | A | 5/1933 | Amsler |
| 1,962,766 | A | 6/1934 | Crowley et al. |
| 1,962,767 | A | 6/1934 | Crowley et al. |
| 1,963,357 | A | 6/1934 | Filley |
| 1,988,577 | A | 1/1935 | Scrimgeour |
| 2,192,486 | A | 3/1940 | Lockhart |
| 2,195,065 | A | 3/1940 | Wallace |
| 2,234,109 | A | 3/1941 | Culpepper |
| 2,269,197 | A | 1/1942 | Hamilton |
| 2,286,208 | A | 6/1942 | Kirchner |
| 2,294,064 | A | 8/1942 | Amstuz |

(Continued)

FOREIGN PATENT DOCUMENTS

| | | |
|---|---|---|
| AT | 75240 | 1/1919 |

(Continued)

OTHER PUBLICATIONS

Tilleke Maschinenbau publication, undated.
Tilleke De-Nibbing Machine publication, undated.

*Primary Examiner*—Robert A. Rose
(74) *Attorney, Agent, or Firm*—Kolisch Hartwell, P.C.

(57) ABSTRACT

A sanding machine includes a conveyer and a sanding assembly for sanding a workpiece by moving the sanding assembly in multiple linear and/or nonlinear motions relative to the conveyed workpiece.

9 Claims, 11 Drawing Sheets

U.S. PATENT DOCUMENTS

| | | | |
|---|---|---|---|
| 2,311,346 | A | 2/1943 | Munn |
| 2,405,328 | A | 8/1946 | Robinson, Jr. |
| 2,412,141 | A | 12/1946 | Ford |
| 2,442,042 | A | 5/1948 | Hamilton |
| 2,447,102 | A | 8/1948 | Strand |
| 2,485,295 | A | 10/1949 | Larson |
| 2,553,254 | A | 5/1951 | Hays |
| 2,579,866 | A | 12/1951 | Rosseau |
| 2,606,947 | A | 8/1952 | Happe |
| 2,641,878 | A | 6/1953 | Radabaugh |
| 2,644,280 | A | 7/1953 | O'Neil, Jr. |
| 2,690,036 | A | 9/1954 | Baldridge |
| 2,700,259 | A | 1/1955 | Dreyfus |
| 2,729,037 | A | 1/1956 | Soccoli |
| 2,751,725 | A | 6/1956 | Champayne |
| 2,787,100 | A | 4/1957 | Peyches |
| 2,843,980 | A | 7/1958 | Bernstein et al. |
| 2,909,871 | A | 10/1959 | Heymes et al. |
| 2,926,465 | A | 3/1960 | Sommers |
| 2,945,330 | A | 7/1960 | Peyches |
| 2,949,707 | A | 8/1960 | Staelin |
| 2,984,051 | A | 5/1961 | Monnet et al. |
| 2,985,989 | A | 5/1961 | Knost |
| 2,989,823 | A | 6/1961 | Bernstein |
| 3,006,116 | A | 10/1961 | Knost |
| 3,026,653 | A | 3/1962 | De Zordo |
| 3,079,734 | A | 3/1963 | Eschenburg |
| 3,094,815 | A | 6/1963 | Pendergast |
| 3,104,503 | A | 9/1963 | Yelpo et al. |
| 3,106,806 | A | 10/1963 | Hutchins |
| 3,107,456 | A | 10/1963 | Walters et al. |
| 3,203,074 | A | 8/1965 | Monaghan |
| 3,263,376 | A | 8/1966 | Walters et al. |
| 3,267,623 | A | 8/1966 | Block |
| 3,271,909 | A | 9/1966 | Rutt et al. |
| 3,339,319 | A | 9/1967 | Schuster et al. |
| 3,353,304 | A | 11/1967 | Chaumont |
| 3,400,501 | A | 9/1968 | Chaumont |
| 3,416,261 | A | 12/1968 | Sherman et al. |
| 3,522,680 | A | 8/1970 | Sarofeen |
| 3,533,193 | A | 10/1970 | Dudek et al. |
| 3,543,449 | A | 12/1970 | Scott et al. |
| 3,608,245 | A | 9/1971 | Fair, Jr. et al. |
| 3,654,738 | A | 4/1972 | Sternal |
| 3,701,219 | A | 10/1972 | Sternal |
| 3,704,559 | A | 12/1972 | Morgan |
| 3,708,817 | A | 1/1973 | Rhine et al. |
| 3,734,700 | A | 5/1973 | Gutierrez et al. |
| 3,754,354 | A | 8/1973 | Franlinna |
| 3,832,807 | A | 9/1974 | Kiser et al. |
| 3,844,069 | A | 10/1974 | Shank |
| 3,847,271 | A | 11/1974 | Culley, Jr. |
| 3,857,206 | A | 12/1974 | Heffran, Jr. |
| 3,859,758 | A | 1/1975 | Hair, Jr. |
| 3,892,091 | A | 7/1975 | Hutchins |
| 3,893,265 | A | 7/1975 | Elm et al. |
| 3,895,462 | A | 7/1975 | Garin |
| 3,906,678 | A | 9/1975 | Roth |
| 4,277,915 | A | 7/1981 | Hausermann et al. |
| 4,343,113 | A | 8/1982 | van der Linden |
| 4,375,738 | A | 3/1983 | Bando |
| 4,399,637 | A | 8/1983 | Steinback |
| 4,475,317 | A | 10/1984 | Dicke |
| 4,505,071 | A | 3/1985 | Schwär |
| 4,615,146 | A | 10/1986 | Tassoni |
| 4,622,783 | A | 11/1986 | König et al. |
| 4,627,195 | A | 12/1986 | Greenleaf |
| 4,635,405 | A | 1/1987 | Stump |
| 4,646,473 | A | 3/1987 | Hundebol |
| 4,651,474 | A | 3/1987 | David |
| 4,656,788 | A | 4/1987 | Rhoades et al. |
| 4,667,447 | A | 5/1987 | Barton |
| 4,720,940 | A | 1/1988 | Green |
| 4,733,500 | A | 3/1988 | David |
| 4,742,650 | A | 5/1988 | Sauder, Jr. et al. |
| 4,754,575 | A | 7/1988 | Schneider |
| 4,759,152 | A | 7/1988 | Berger et al. |
| 4,787,178 | A | 11/1988 | Morgan et al. |
| 4,788,798 | A | 12/1988 | DeFranco et al. |
| 4,798,025 | A | 1/1989 | Lokken et al. |
| 4,833,832 | A | 5/1989 | Lindsey et al. |
| 4,837,984 | A | 6/1989 | David |
| 4,845,898 | A | 7/1989 | Preis |
| 4,864,775 | A | 9/1989 | David |
| 4,878,317 | A | 11/1989 | Ovens |
| 4,891,916 | A | 1/1990 | Rhoades et al. |
| 4,969,296 | A | 11/1990 | Seki et al. |
| 5,018,314 | A | 5/1991 | Fushiya et al. |
| 5,170,588 | A | 12/1992 | Schaal et al. |

FOREIGN PATENT DOCUMENTS

| | | | |
|---|---|---|---|
| DE | 41420 | 7/1900 | |
| DE | 186965 | 2/1905 | |
| DE | 266932 | * 11/1913 | ..... 451/121 |
| DE | 1556287 | 3/1972 | |
| DE | 2740696 | 3/1979 | |
| DE | 8808679.8 | 12/1988 | |
| DE | 8912042.6 | 1/1990 | |
| EP | 0 117 585 | 9/1984 | |
| FR | 567783 | 3/1924 | |
| FR | 597948 | 12/1925 | |
| FR | 1085718 | 2/1955 | |
| JP | 58-41084 | 7/1981 | |
| JP | 62-297066 | 6/1986 | |
| JP | 63-11275 | * 1/1988 | ..... 451/59 |
| NL | 8802627 | 5/1990 | |
| SU | 158815 | 11/1963 | |
| SU | 178476 | 3/1966 | |
| SU | 222894 | 10/1968 | |
| SU | 334040 | 4/1972 | |
| SU | 351679 | 12/1972 | |
| SU | 905004 | 2/1982 | |
| SU | 1138297 | 8/1983 | |
| SU | 1242339 | 7/1986 | |
| SU | 1433770 | 10/1986 | |
| SU | 1546236 | 8/1987 | |
| SU | 1569190 | 2/1988 | |

* cited by examiner

SANDING MACHINE INCORPORATING MULTIPLE SANDING MOTIONS

This application is based upon and claims priority under 35 U.S.C. §119 from U.S. Provisional Patent Application Ser. No. 60/309,948, filed Aug. 2, 2001, which is incorporated herein by reference in its entirety for all purposes. The following patent applications and issued patent are hereby incorporated by reference: application Ser. No. 08/993,699 filed Dec. 18, 1997; application Ser. No. 08/477,069 filed Jun. 7, 1995, now issued as U.S. Pat. No. 5,702,287; application Ser. No. 08/260,360 filed Jun. 15, 1994, now issued as U.S. Pat. No. 5,443,414; application Ser. No. 08/006,379 filed Jan. 19, 1993, now issued as U.S. Pat. No. 5,321,913; application Ser. No. 07/787,897 filed Nov. 5, 1991, now issued as U.S. Pat. No. 5,181,342; application Ser. No. 07/568,902 filed Aug. 17, 1990, now issued as U.S. Pat. No. 5,081,794.

FIELD OF THE INVENTION

This invention relates to a sanding machine. More particularly, the invention relates to a sanding machine that utilizes an abrasive surface, and that can impart multiple independent sanding motions to the abrasive surface.

BACKGROUND OF THE INVENTION

A sander is a machine that uses an abrasive such as sandpaper to smooth or polish a workpiece composed of wood, stone, plastic, or other such material. Typically, the abrasive is moved back and forth across the product, abrading its surface and thereby smoothing it. Different abrasives can be used to achieve different results. For example, a coarse grit abrasive is used to abrade quickly and deeply. A fine grit abrasive is used to produce the final, desired smoothness.

However, even sanding machines that use a fine grit abrasive can leave sanding patterns in the product. A sanding pattern is simply a collection of scratches in the product's surface. For wood products, cross-grain sanding patterns, or scratches running across the wood's grain can result. To remove sanding patterns, finish sanding is often done by hand with a hand-held sander or with steel wool.

The invented sander provides an alternative to hand-held finishing sanders while removing sanding patterns, by applying the abrasive to the surface to be sanded using multiple independent motions. In other words, the invented sander eliminates the need for finish sanding to be done by hand.

SUMMARY OF THE INVENTION

Sanding machine embodiments of the invention may include a conveyor, a sanding assembly, and a drive system. The conveyer carries a product into the sander for sanding. The sanding assembly may include at least one abrasive surface. The drive system is configured to impart at least two nonlinear motions relative to the product and the abrasive surface, in addition to the motion of the product being conveyed into the sander by the conveyer, so that the product may be sanded when it contacts the abrasive surface.

The advantages of the present invention will be understood more after a consideration of the drawings and the Detailed Description.

DETAILED DESCRIPTION AND BEST MODE OF THE INVENTION

Figure 1:
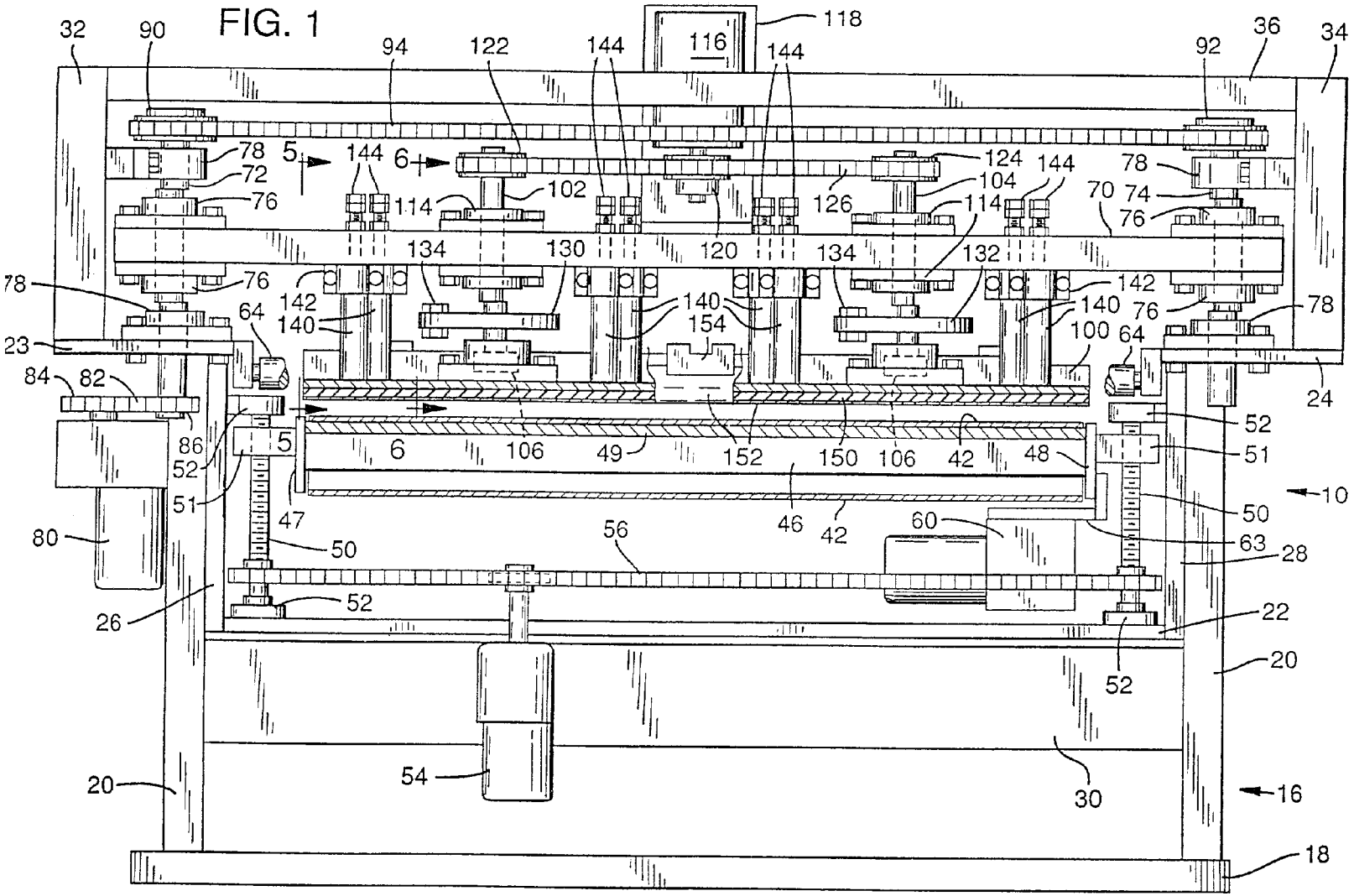
FIG. 1 is a front elevational view of a sanding machine according to an embodiment of the invention.

The sanding machine of the invention includes a frame, a conveyer, at least a first drive shaft that supports a brace and that causes the brace to move in a first orbit, and at least one sanding assembly that is supported by the brace and that includes an abrasive surface, where the sanding assembly incorporates at least a first drive mechanism that causes the abrasive surface to move in an additional independent motion. The brace optionally incorporates a second drive shaft that causes the brace to move in a second, independent orbit. The sanding assembly optionally incorporates additional drive mechanisms to impart additional motion to the abrasive surface or surfaces. The invented sander may also include a conveyor to feed a product toward the sanding assembly and/or a rotating brush to abrade and polish the product after it has been sanded by the abrasive surface.

For the purposes of generally showing the frame, conveyer, first drive shaft, and brace of the sander of the invention, and to indicate the action of the conveyor and the rotating brush, a sander is shown generally at 10 in FIGS. 1–4 that incorporates those features, as well as a sanding assembly. Sander 10 is housed in a protective casing 12 and it is controlled by a control panel 14, both of which are shown in dashed lines in FIG. 2. Casing 12 may be removed to allow for maintenance and repair of the invented sander. Casing 12 may also include ports or apertures to access the enclosed structure.

Inside of casing 12 the sander is supported by a frame 16, including a horizontal base support 18 and a plurality of vertical supports 20. In the embodiment shown in the drawings, there are three vertical supports 20 on each side of the sander.

Frame 16 also includes horizontal support plates 22, 23 and 24. Plates 22 and 23 are connected by vertical support plate 26 and plates 22 and 24 are connected by vertical support plate 28. Plates 26 and 28 are, in turn, connected to vertical supports 20 on their respective sides of the sander. A cross support 30 extends from one side of the sander to the other and connects two of the vertical supports 20.

Mounted to horizontal support plates 23 and 24, respectively, are two additional vertical supports 32 and 34. Supports 32 and 34 are positioned one on each side of the sander. Extending across the sander between supports 32 and 34 is a horizontal beam 36.

The above-described pieces of frame 16 may be welded together or joined by any known means. Of course, variations and modifications may be made to the frame depending on the desired size and configuration of the sander.

The invented sander also includes a conveyor belt assembly 40, including a conveyor belt 42 extending around rollers 44 and 46. The rollers are connected on one side by support 47 and on the other side by support 48. A plate 49, connected to supports 47 and 48, extends between rollers 44 and 46 and under the top surface of belt 42 to support the belt.

Supports 47 and 48 are mounted to screws 50 by threaded couplings 51. Screws 50 are mounted to frame 16 by bearings 52 which allow the screws to rotate. The screws are rotated by a motor 54 and a chain 56 driven by the motor which extends around toothed pulleys attached to the screws. By turning the screws 50, the conveyor belt assembly can be raised or lowered to any desired position. Alternatively, a hand operated mechanism may be used to raise and lower the conveyor assembly.

Figure 2:
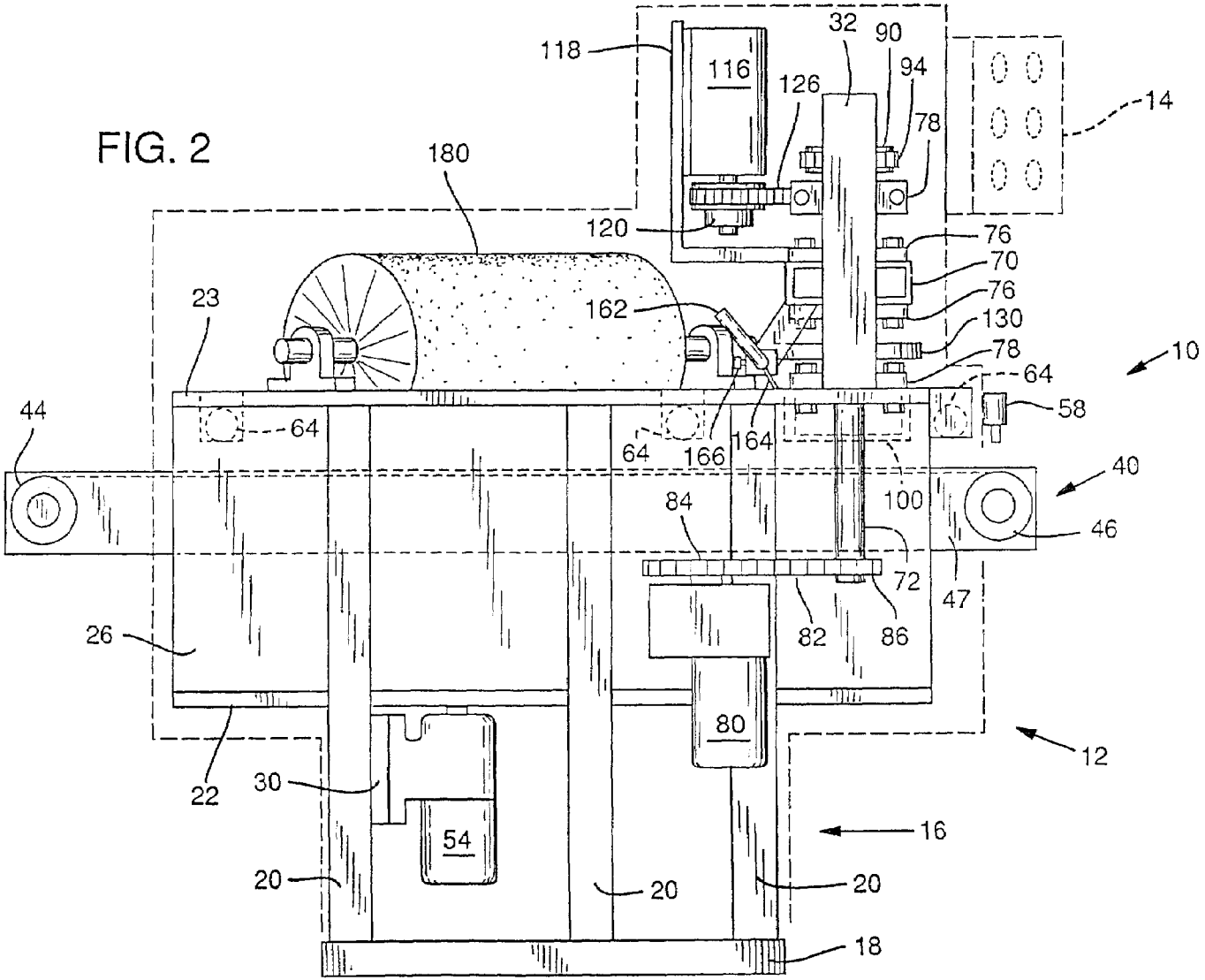
FIG. 2 is a side elevational view of a sanding machine according to an embodiment of the invention.
Figure 3:
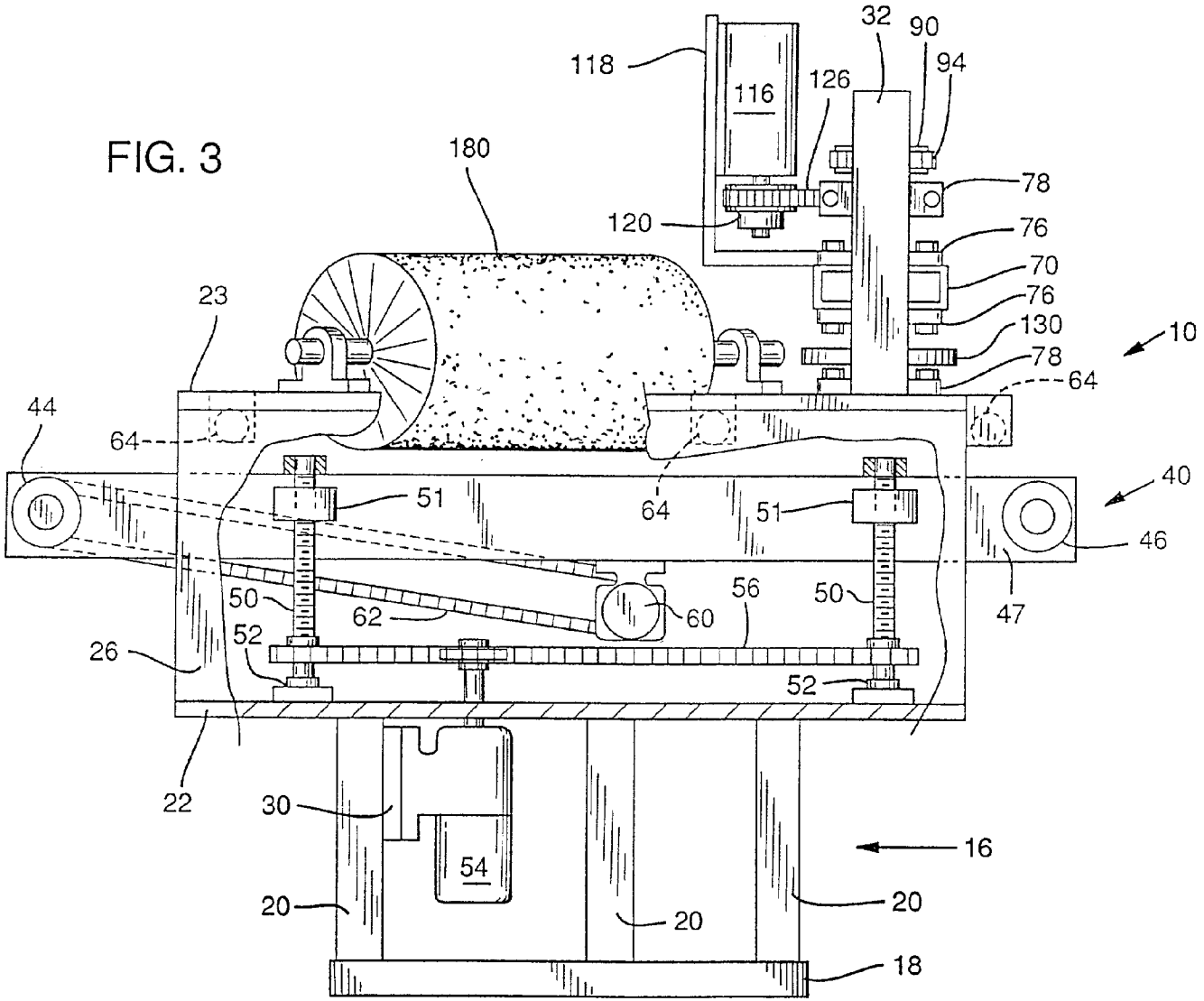
FIG. 3 is a view of a sanding machine similar to that of FIG. 2 but with parts of the invention broken away to show additional detail.

A gauge 58, shown attached to casing 12 in FIG. 2, is used to indicate the elevation or height of a product placed on the conveyor belt. For example, a wood product, such as a cabinet panel, is placed on the conveyor belt when it is lowered. Rotating screws 50 causes the conveyor belt and the panel to rise and contact the gauge which indicates when the conveyor and panel have reached the desired position. Gauge 58 may simply be an analog dial with a spring-biased point that is pushed up when the conveyor belt assembly and wood panel is raised.

Conveyor belt 42 is powered by roller 44, which in turn is rotated by a motor 60 and a chain 62 extending between the motor and the roller. Motor 60 is mounted to support 48 of the conveyor belt assembly by a mount 63. Thus, motor 60 and chain 62 rise and lower with the conveyor belt when the belt assembly is raised and lowered. Idler or tensioning gears (not shown) may be positioned between motor 60 and roller 44 to maintain the appropriate tension on chain 62. Alternatively, a belt can be used to drive roller 44. Opposed and driven pinch rollers can also be used instead of a conveyor belt. For small applications, stationary guides can be used to hand feed the invented sander. "Conveyor means" is used herein to describe all these structures.

Positioned above the conveyor belt assembly, and mounted to the frame, are several pinch rollers 64. Products placed on conveyor belt 42 are held in place by pinch rollers 64 as they are fed through the invented sander.

Figure 8:
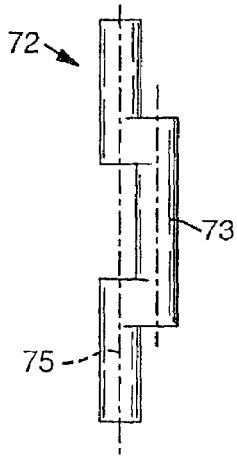

The invented sander also includes a brace 70, shown best in FIG. 1. Brace 70 is connected to two drive shafts 72 and 74. Drive shaft 72 is shown isolated from other structure in FIG. 8. As can be seen, shaft 72 includes a step portion 73 that extends away from and then returns to the longitudinal axis 75 of the shaft. When shaft 72 is rotated around axis 75, section 73 orbits around the axis. In the preferred embodiment, the step in shaft 72 is 5/32nds-of-an-inch, creating an orbit with a diameter of 5/16ths-of-an-inch. Shaft 74 is similar to shaft 72 and brace 70 is mounted to the two shafts around the shafts' stepped portions. Thus, when the shafts are rotated, their stepped portions as well as brace 70 move in an orbit. Eccentric cams may be used instead of stepped drive shafts 72 and 74.

Brace 70 is mounted to shaft 72 by bearings 76 bolted to the brace. Shaft 72 is mounted to frame 16 by bearings 78 connected to plate 23 and support 32, as shown in FIG. 1. Shaft 74 is mounted to plate 24 and support 34 in a similar fashion.

A motor 80, mounted to one of the vertical supports 20, rotates shaft 72 by a chain 82 extending around a pulley 84 mounted to the motor's drive shaft and a pulley 86 mounted to the lower end of shaft 72. A pulley 90 is mounted to the upper end of shaft 72 and a similar pulley 92 is mounted to shaft 74. A chain 94 extends around pulleys 90 and 92 and an idler or tensioning gear 96 (shown in FIG. 4 only) maintains tension in the chain. Motor 80 rotates shaft 72 which in turn rotates shaft 74 by chain 94 extending around pulleys 90 and 92. As stated, rotating shafts 72 and 74 causes brace 70 to move in an orbit or circular pattern.

The sander also includes a sanding assembly 100. The sander of FIGS. 1–4 is shown with a sanding assembly that is a simple platen. However, the sanding assembly of the invention typically incorporates one or more additional drive mechanisms, and at least one abrasive surface, as discussed in greater detail below.

In a particular aspect of the invention, the sanding assembly 100 is coupled to drive shafts 72 and 74 by an additional pair of drive shafts, 102 and 104. Additional drive shafts 102 and 104 are configured to impart an additional, independent orbital motion to the sanding assembly 100.

Sanding assembly 100 is typically connected to the drive shafts 102 and 104 (when present) by standard flange mount bearings 106 which are bolted to the sanding assembly. The use of standard flange mount bearings allows for self-alignment of the shafts when they are rotated. The sander can be constructed with only one shaft supporting the sanding assembly, but the use of two or more shafts results in greater stability for the sanding assembly. Eccentric cams can be used instead of shafts 102 and 104.

Figure 7:
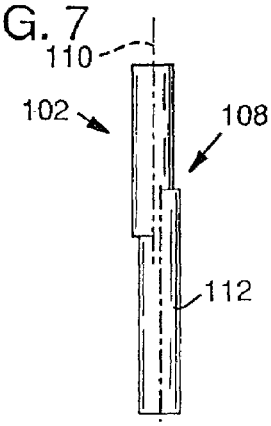
FIGS. 7 and 8 are simplified views of the drive shafts used in the preferred embodiment of the invention.

Shaft 102 is shown in FIG. 7 isolated from other structure. As can be seen in FIG. 7, shaft 102 includes a step 108 that extends away from the longitudinal axis 110 of the shaft. Step 108 causes a portion 112 of shaft 102 to orbit around the shaft's longitudinal axis when the shaft is rotated. In the preferred embodiment, step 108 is 1/16th-of-an-inch, resulting in an orbit having a diameter of 1/8th-of-an-inch. Shaft 104 is identical to shaft 102. Shafts 102 and 104 are connected to brace 70 by bearings 114.

A motor 116 is also connected to brace 70 by a mount 118. A timing pulley 120 is mounted to the drive shaft of the engine, a similar timing pulley 122 is mounted to the upper end of shaft 102 and a timing pulley 124 is mounted to the upper end of shaft 104. A toothed timing belt 126 extends around pulleys 120, 122 and 124 and rotates shafts 102 and 104 when motor 116 rotates pulley 120. Shafts 102 and 104, in turn, cause sanding assembly 100 to orbit or move in a circular pattern. The toothed belt and timing pulleys allow for perfect timing between shafts 102 and 104. Motor 116 is centered between pulleys 122 and 124 to eliminate the need for idlers on belt 126.

Disks 130 and 132 are mounted to the lower portions of shafts 102 and 104, respectively, to counterbalance the motion of sanding assembly 100. Weights 134 are attached to the disks and positioned opposite the step in the shaft to create the necessary counterbalance weight. Weights 134 may be made from nuts, bolts and washers and are therefore adjustable. Holes may be drilled in disks 130 and 132 to accommodate any number of bolts.

As can be understood from the structure described so far, sanding assembly 100 moves in two orbits, one created by the rotation of shafts 102 and 104 and the other created by the rotation of brace 70. This dual rotation simulates the motion of sanding by hand. Shafts 102 and 104 typically rotate at 3,000 to 12,000 revolutions per minute while shafts 72 and 74 typically rotate at approximately 200 revolutions per minute. Shafts 102 and 104 may rotate in the same direction or in the opposite direction as shafts 72 and 74. Any structure capable of driving the sanding assembly and abrasive in one or more orbits may be used, such as the motor and drive shaft structure described above. As described above, the sander may alternatively be constructed so that the sanding assembly is subjected to only one orbiting motion. One orbit allows for a smaller and less expensive machine, and where the sanding assembly itself imparts additional motion or motions to the abrasive surface, one orbit may be sufficient for the requirements of the sander.

Figure 5:
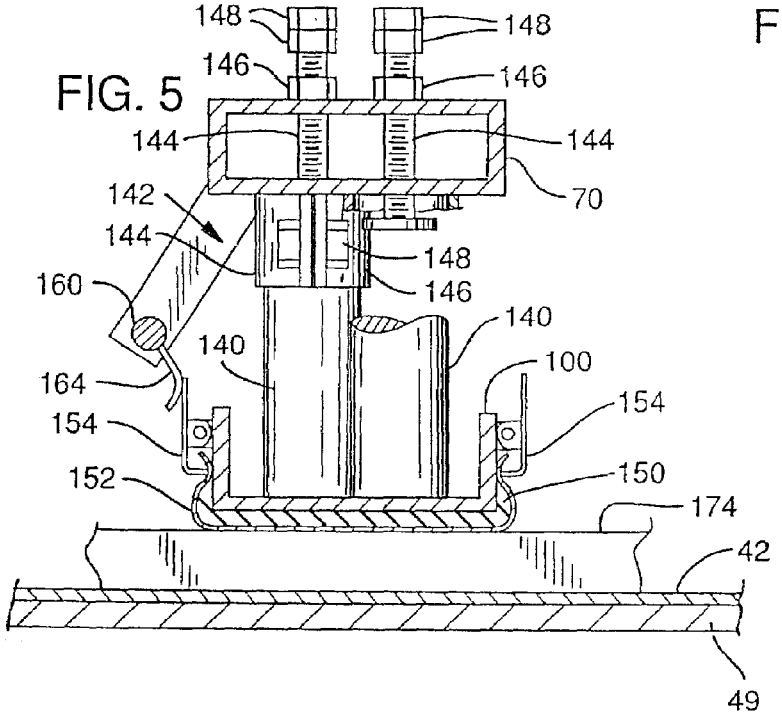
FIG. 5 is a simplified sectional view taken along the line 5—5 in FIG. 1.

Positioned between brace 70 and platen 100 are eight stabilizers 140. As best seen in FIGS. 1 and 5, each stabilizer is secured to brace 70 by a C-clamp 142. The C-clamp is made from two opposed, C-shaped parts, 144 and 146, one of which is welded to brace 70. A stabilizer is inserted between the two parts which are then bolted together by a bolt such as bolt 148.

As shown, the lower end of each stabilizer simply rests against the inner surface of sanding assembly 100. The pressure exerted by each stabilizer against sanding assembly 100 is adjusted by elevator bolts 144. There is one elevator bolt for each stabilizer. Each elevator bolt is similar to a plunger and includes a threaded stud with a flat surface attached to one end. Each bolt is threaded through a tapped hole in brace 70. As seen in FIG. 5, a jam nut 146 and opposed nuts 148 are threaded onto the upper end of each elevator bolt. Loosening jam nut 146 allows for the elevator bolt to be tightened by nuts 148. Tightening the elevator bolt increases the pressure against stabilizer 140 which in turn increases the pressure against sanding assembly 100. When the desired pressure is obtained, jam nut 146 is tightened to secure the elevator bolts in position.

In this manner, the stabilizers are adjustable to level the sanding assembly, cause the sanding assembly to apply increased pressure at a certain point, or to compensate for wear. Additionally, the stabilizers maintain the sanding assembly level while still allowing it to move in two different orbits. In other words, because stabilizers 140 are made of rubber or synthetic rubber and are therefore partially deformable, sanding assembly 100 can remain level while moving in the orbit created by shafts 102 and 104 as well as in the orbit created by shafts 72 and 74.

The sanding assembly 100 includes a mechanism for applying an abrasive to the workpiece. The sanding assembly may incorporate a variety of configurations, including mechanisms that incorporate one or more drive mechanisms for imparting additional motion to the abrasive surface, and various methods of mounting the abrasive surface or surfaces. In every embodiment, an abrasive material is secured to the sanding assembly. "Secured" means that the abrasive's motion is completely dependent on the motion imparted by the sanding assembly. Thus, when the sanding assembly moves the abrasive also moves.

The abrasive optionally incorporates a resilient material beneath the abrasive surface, such as a foam pad. The foam is typically positioned between the platen and the abrasive to provide a soft touch to prevent the abrasive's grit from scratching into a product too deeply. Without the foam, unwanted scratches may result from products that are not perfectly flat.

Figure 6:
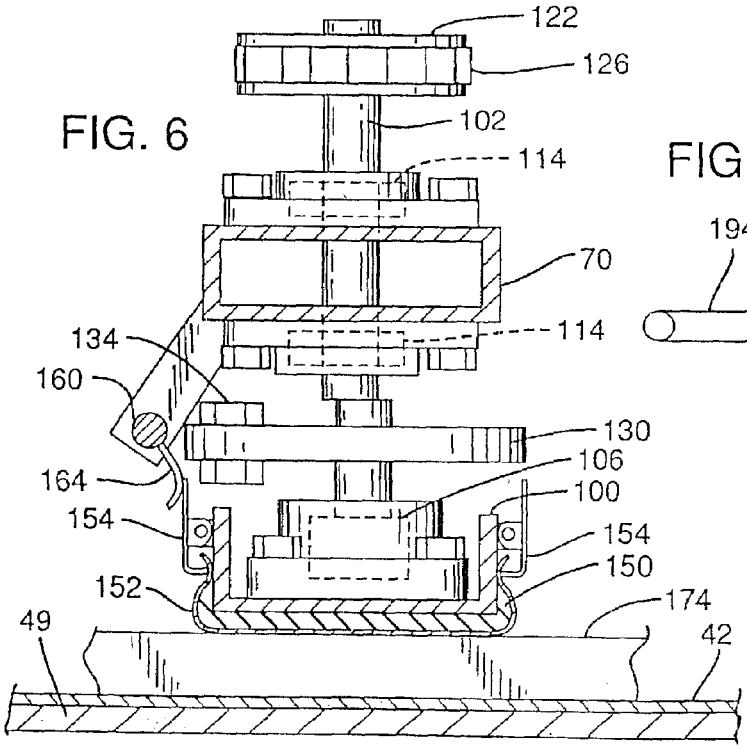
FIG. 6 is a simplified sectional view taken along the line 6—6 in FIG. 1.

In one aspect of the invention shown in FIGS. 1–6, the sanding assembly includes a platen. As best seen in FIGS. 1, 5 and 6, a foam pad 150 is attached to the outer, bottom surface of platen 100. The pad is typically made from a deformable yet firm foam and is secured to the platen by an adhesive. For some applications, a sponge rubber or a rubber having a light durometer may be used. An abrasive 152 is secured to the platen around foam 150. Clips 154 are used to secure the abrasive to the platen. Alternatively or additionally, the abrasive may be secured to the foam and platen by an adhesive.

As shown in FIGS. 5 and 6, clips 154 are positioned on both sides of platen 100. A spring-biased rod 160 (shown best in FIGS. 4–6) is used to operate the clips on the back side of the platen. The rod includes a handle 162 and arms 164. When the handle is pushed down, the rod rotates and the arms contact the clips and cause them to open. The rod can then be locked in place by locking mechanism 166. The abrasive is then inserted between the clips and the platen. The clips close when the rod is released. In the preferred embodiment, the rod is secured to brace 70.

Figure 9:
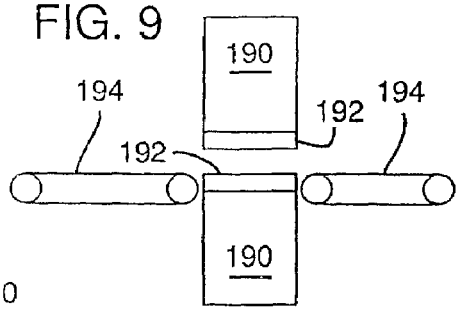
FIG. 9 is a simplified drawing of an embodiment of the invention having opposed orbiting platens.

FIG. 9 shows an alternative sander embodiment including two sanding assemblies 190 positioned opposite each other. Each sanding assembly including an abrasive surface 192. A conveyor belt 194 feeds wood between the two assemblies, thereby allowing two surfaces of the wood to be abraded simultaneously. Alternatively, the sanding assemblies may be arranged side-by-side in a row.

FIGS. 10–21 show alternative embodiments of the invention that combine various orbital, circular, linear, and/or nonlinear motions to provide enhanced sanding results. Preferably, the sander of the invention includes a sanding assembly that imparts one or more additional motions to the abrasive surface or surfaces. The additional motions imparted to the abrasive surface may include linear motions or nonlinear motions. The additional motions may be independent motions, or two or more of the additional motions may be coupled. In one aspect of the invention, the sanding assembly imparts a nonlinear motion to the abrasive surface or surfaces, in addition to the first and optionally second orbital motions applied to the brace. In another aspect of the invention, the sanding assembly imparts a linear motion to the abrasive surface or surfaces, in addition to a first and second orbital motions applied to the brace. In yet another aspect of the invention, the conveyer imparts at least one nonlinear motion to the product, relative to the abrasive surface.

The sanding machine may incorporate one or more sanding assemblies that may each include one or more platens, sanding belts, and/or sanding drums, in any combination, that are capable of single or multiple additional driven or non-driven sanding motions. Where the sanding assembly includes a platen, the platen is optionally an elongate platen, a platen structure, or a platen array. Where the sanding assembly includes a sanding belt, the sanding belt is optionally a wide sanding belt or a narrow sanding belt, and may be disposed on single or multiple rollers, including one or more tensioning rollers. Each sanding assembly, or plural sanding assemblies, may be utilized in the sanding machine described above instead of platen 100, and therefore impart one or more sanding motions to the product in addition to those applied by the rotation of shafts 102 and 104 and the rotation of brace 70.

Figure 10:
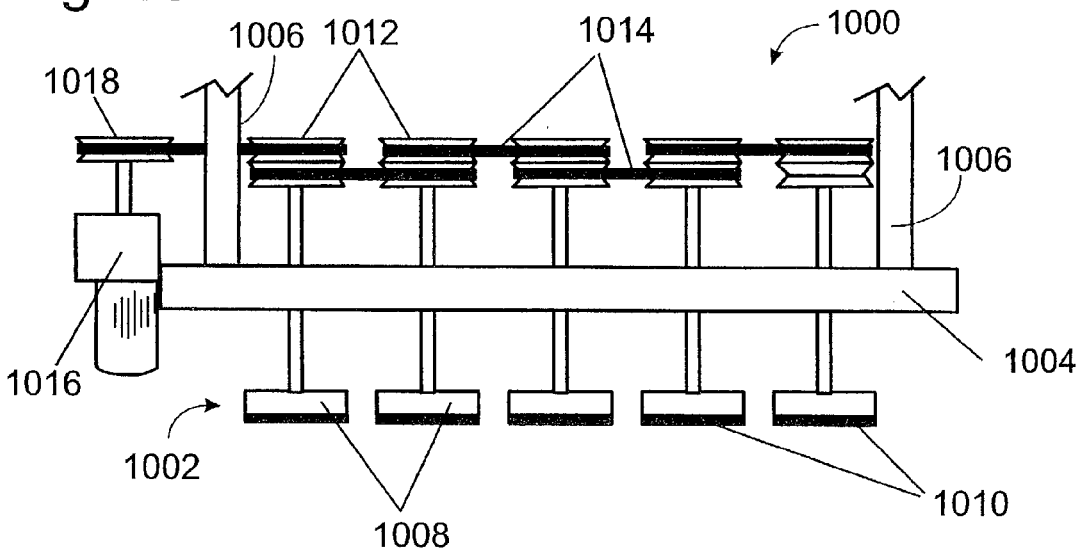
FIG. 10 is a schematic side view of a sanding assembly that incorporates a plurality of sanding heads.

For example, as shown in FIG. 10, the sanding assembly of the invention 1000 incorporates a plurality of sanding heads 1002 held by or mounted within a platform 1004. Positioned between a brace (not shown) and platform 1004 are two stabilizers 1006. The number and composition of stabilizers may vary depending on the amount of pressure to be exerted by the sanding assembly. As discussed above, the pressure exerted by each stabilizer 1006 can be adjusted by elevator bolts.

Figure 11:
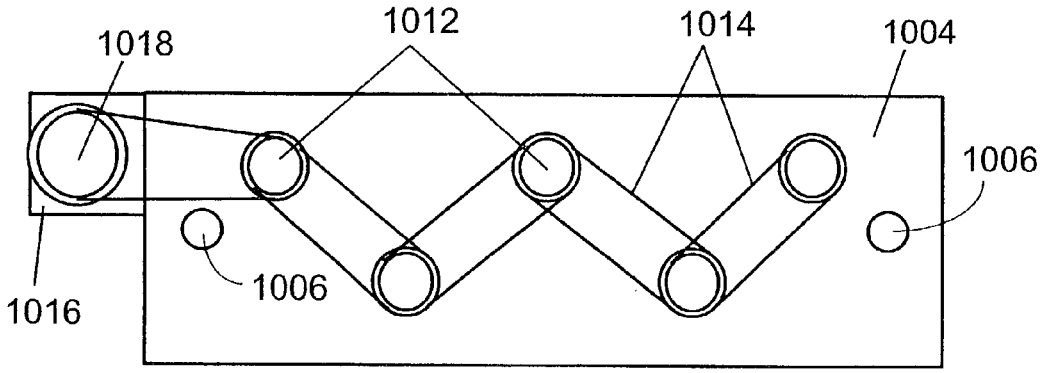
FIG. 11 is a schematic top view of the sanding assembly of FIG. 10.

Sanding assembly 1000 of FIG. 10 includes five sanding heads 1008, each incorporating a flat abrasive surface 1010. As shown in FIGS. 10–11, each sanding head is rotatable via drive pulleys 1012 and drive belts 1014, serving to transfer the motion from drive motor 1016 and drive pulley 1018 to the sanding heads. In one aspect of the invention, the drive system includes pulleys and V-belts, however any drive mechanism that imparts the desired motion to the sanding heads is a suitable drive mechanism, including chain drives, direct drive shafts, magnet driven systems, solenoids, or pneumatic or air driven systems. The sanding assembly of FIGS. 10–11 imparts an individual rotation to each sanding head, in addition to the one or more orbital motions imparted onto the sanding assembly as a whole. Alternatively, in a modification of the assembly shown in FIG. 12, each sanding head may be driven by a separate motor, for example, such as a motor used in a single hand-held orbital sander. Further, additional orbital motions may be created by mounting the heads on eccentric shafts or by mounting the shafts acentrally on the respective circular heads.

Figure 12:
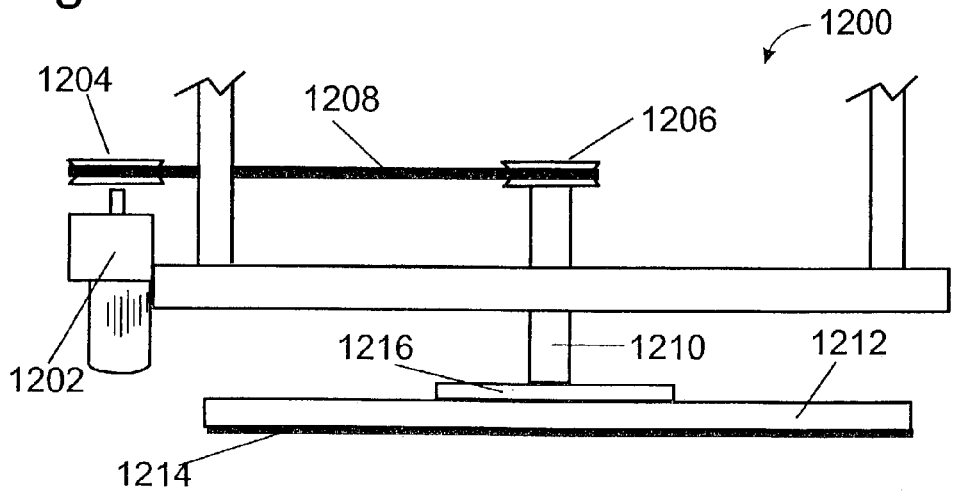
FIG. 12 is a schematic side view of a sanding assembly that incorporates a rotating disk.

Rather than a plurality of sanding heads, the sanding assembly optionally incorporates a single sanding disk, as shown in sanding assembly 1200 of FIG. 12. Drive motor 1202 and drive pulley 1204 cooperate with pulley 1206 and belt 1208 to rotate shaft 1210, and thereby rotate sanding disk 1212. Sanding disk 1212 includes an abrasive surface 1214, and is cooperatively attached to 1210 by plate 1216. Plate 1216 may be attached to disk 1212 by a plurality of bolts, for example, or any other suitable fastening means.

In one aspect of the invention, sanding disk 1212 is centered on shaft 1210, such that the sanding disk rotates smoothly in a circular motion. However, in another aspect of the invention, the sanding disk is mounted to the shaft such that an eccentric motion is imparted to the sanding disk. For example, the shaft itself may incorporate a step so that rotation of the shaft results in the abrasive surface moving in an eccentric orbit. In this embodiment, the degree of eccentricity in the motion of the sanding disk is determined by the degree of offset of the step. As discussed above with respect to shaft 102 and 104, even a fraction of an inch of eccentricity results in effective orbital motion for the purposes of the invention.

Figure 13A:
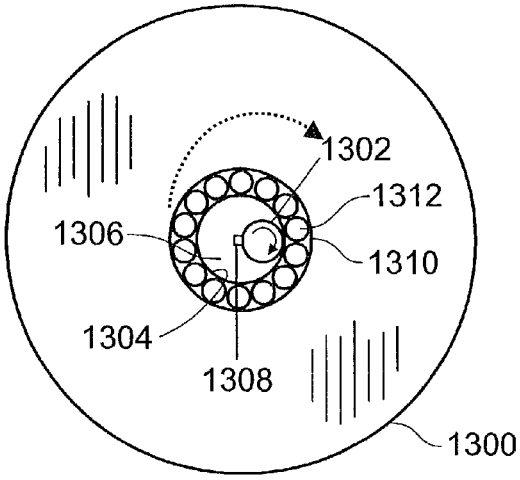
FIG. 13A is a schematic top view of a sanding disk showing a mechanism that imparts eccentric motion to the disk.
Figure 13B:
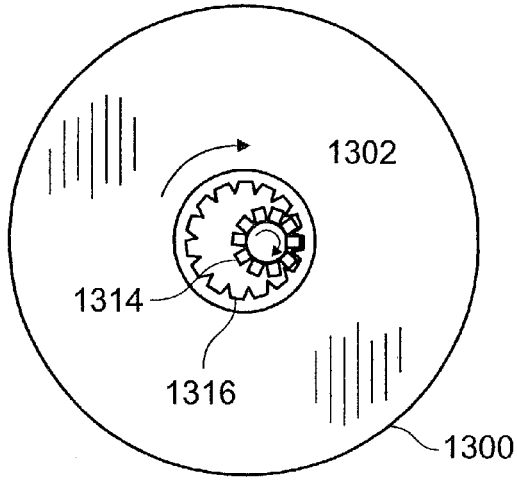
FIG. 13B is a schematic top view of an eccentric sanding disk showing a mechanism that imparts rotational motion to the disk.

Alternatively, the sanding disk may be mounted to the shaft using an alternative mechanism for imparting eccentric motion. For example, sanding disk 1300 with a central aperture 1304 is mounted on shaft 1302 in an offset position with respect to the center of the disk. An eccentric plug 1306 fills the central aperture 1304 with a hole to accommodate shaft 1302. A key 1308 locks the plug in position relative to shaft 1302, but a bearing race 1310 with ball bearings 1312 permit plug 1306 to rotate freely within the central aperture 1304. Rotation of shaft 1302 produces an eccentric orbit of the disk around the shaft, while the bearing race 1310 permit the disk itself to rotate freely in a non-driven manner.

Where it is desired to drive the rotation of disk 1300 as well, the sanding disk may have a second layer, as shown in FIG. 13B, that includes a drive sprocket 1314 coupled to shaft 1302, where the drive sprocket interacts with gear teeth 1316 mounted to the sanding disk. Rotation of shaft 1302 therefore generates both rotation of the sanding disk as well as the eccentric rotation of the disk around the shaft. The cycle rate of the orbital and circular motions can be independently controlled by modifying the gearing used to rotate the sanding disk.

Figure 14:
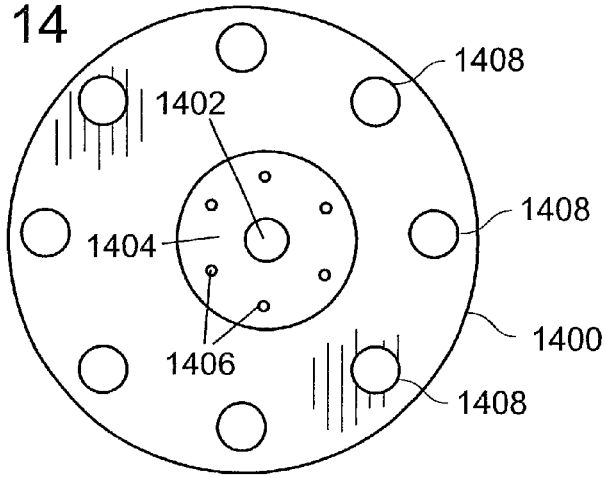
FIG. 14 is a schematic top view of an eccentric rotating disk that incorporates a plurality of sanding heads.

Alternatively, sanding disk 1400 may be cooperatively attached to shaft 1402 by plate 1404, as shown in FIG. 14. In this example, plate 1404 is attached to disk 1400 by a plurality of fasteners 1406. Shaft 1402 is offset from the center of disk 1400, so that rotation of shaft 1402 results in the sanding disk moving in an eccentric orbit. The degree of eccentricity in the motion of disk 1400 is determined by the degree of offset of shaft 1402 with respect to the center of then disk. The sanding assembly may include a disk carrying an abrasive. Alternatively, sanding disk 1400 may optionally incorporate a plurality of sanding heads 1408, as shown in FIG. 14. Sanding heads 1408 may be symmetrically disposed on disk 1400, and optionally further include drive mechanisms for imparting an additional motion to their abrasive surface. For example, individual heads may be mounted and driven on straight or eccentric shafts.

Figure 15:
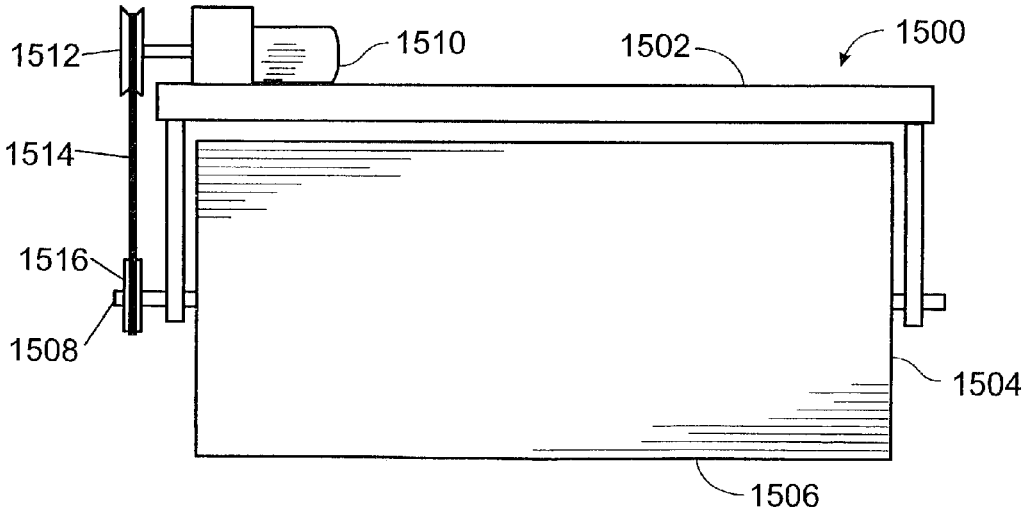
FIG. 15 is a schematic side view of a sanding assembly that incorporates a sanding drum.

In another embodiment of the invention shown in FIG. 15, sanding assembly 1500 incorporates a platform 1502 from which depends a sanding drum 1504. The sanding drum 1504 is covered with an abrasive surface 1506, typically a band or sheet of abrasive material, and is rotated via axle 1508 by a drive mechanism 1510. The drive mechanism of FIG. 15 includes a drive motor 1510, drive pulley 1512, and drive belt 1514. A variety of other drive mechanisms are possible, including direct drive, or a chain drive. Likewise, the axle pulley 1516 may be replaced by a bushing or other fitting for imparting rotational motion to the drum 1504.

Figure 16:
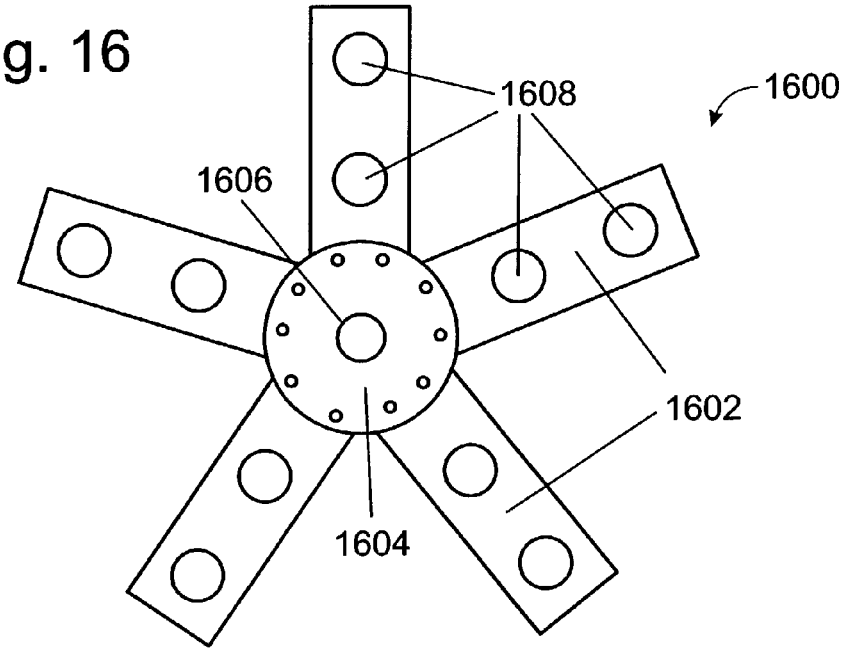
FIG. 16 is a schematic top view of a sanding assembly that incorporates radial arms, where each arm incorporates one or more sanding heads.

In an alternative to the sanding disks illustrated in FIGS. 12–14, a sanding assembly 1600 may incorporate an array of rotating arms 1602 that are fastened to a disk 1604 that is rotated by a shaft 1606, as shown in FIG. 16. As shown, shaft 1606 is concentric with disk 1604 and the radial array of arms 1602. Alternatively, shaft 1606 may be mounted to disk 1604 in such a way as to impart an eccentric orbit to the motion of the arms, as discussed above. Arms 1602 typically incorporate a plurality of sanding heads 1608, as shown in FIG. 16, and the rotating arms of FIG. 16 optionally include one or more drive mechanism for the sanding heads 1608, as needed.

Figure 17:
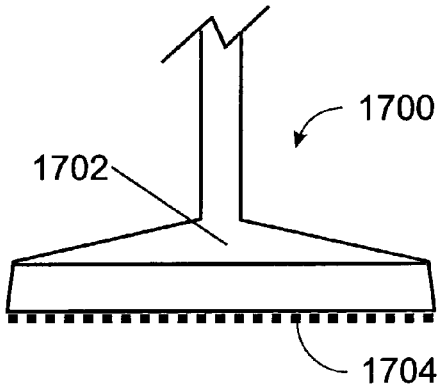
FIG. 17 is a schematic side view of a sanding head.

A variety of useful sanding heads may be used in combination with the sanding assemblies discussed herein. In the embodiment shown in FIG. 17, the sanding head 1700 consists of a support 1702 for an abrasive surface 1704. The abrasive surface is optionally sandpaper, and may include a foam pad, as discussed above. The sanding head of FIG. 17 is typically supported by a platform and may be subjected to additional motion, such as rotation, for example as shown in FIGS. 10 and 11.

Figure 18:
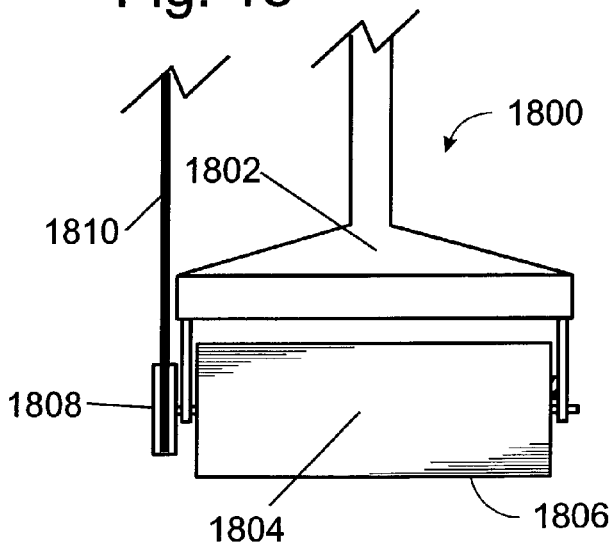
FIG. 18 is a schematic side view of a sanding head that incorporates a sanding drum.

Alternatively, the sanding assembly may incorporate one or more sanding heads that themselves incorporate small sanding drums, as shown in FIG. 18. Sanding head 1800 includes a support 1802, a drum 1804 having an abrasive surface 1806, an axle pulley 1808, and a drive belt 1810. The sanding assembly may include individual drive motors for the sanding drum of each sanding head. Alternatively, a single drive mechanism may be used to rotate each sanding drum for the entire sanding assembly, by means of a power transfer mechanism.

Figure 19:
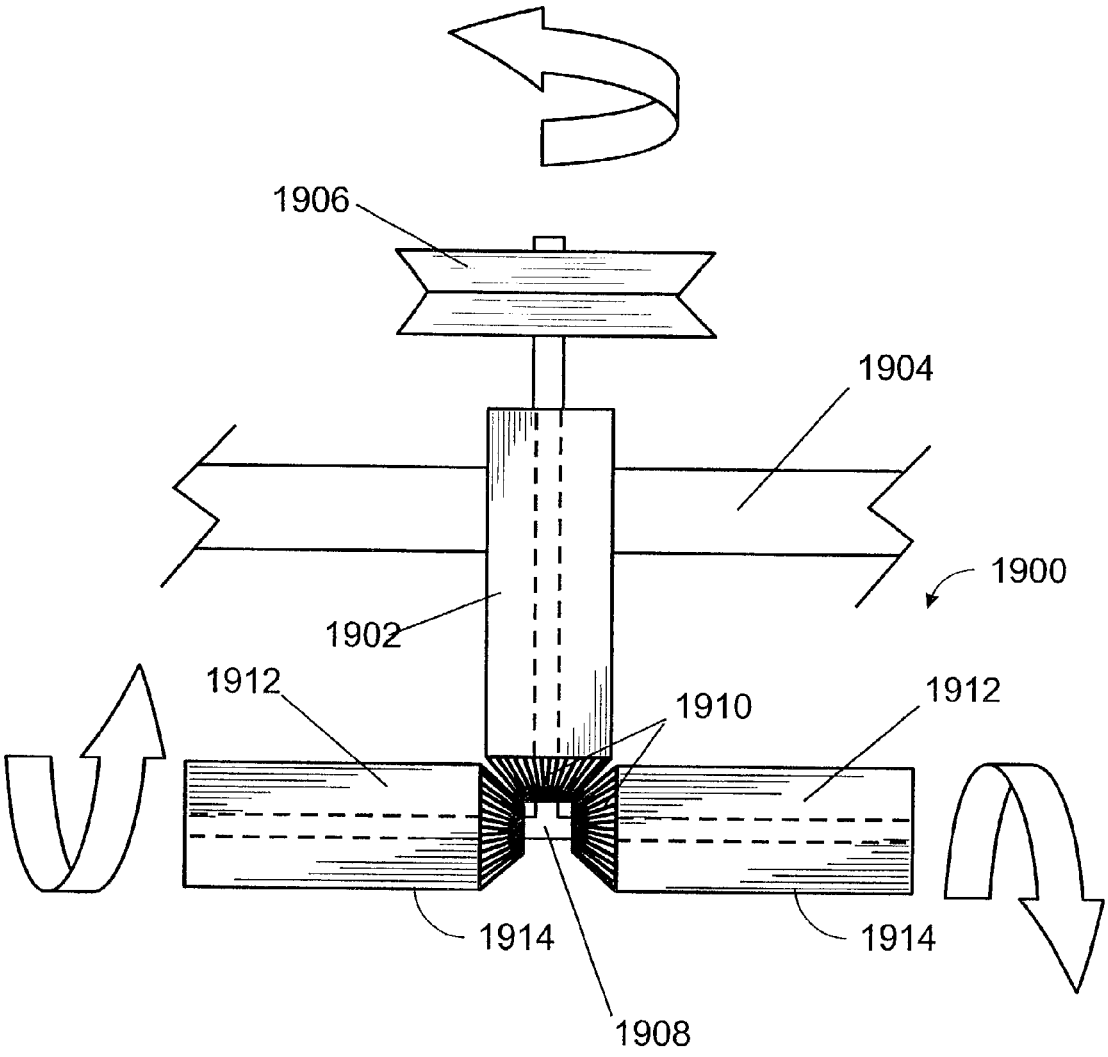
FIG. 19 is a schematic side view of a sanding head that incorporates counter-rotating sanding drums.

In yet another embodiment of the invention, the sanding assembly incorporates a plurality of sanding heads that include counter-rotating sanding drums, as shown in FIG. 19. In the sanding head 1900 of FIG. 19, a stationary cylinder 1902 is mounted in platform 1904. Rotation of the pulley 1906 by a suitable drive mechanism in turn rotates the T-shaped bar 1908. As cylinder 1902 is fixed in place, rotation of T-bar 1908 in cooperation with bevel gears 1910 results in rotation of sanding drums 1912 in opposite directions, as shown by the arrows in FIG. 19. Sanding drums 1912 are covered with a suitable abrasive surface 1914.

Figure 20:
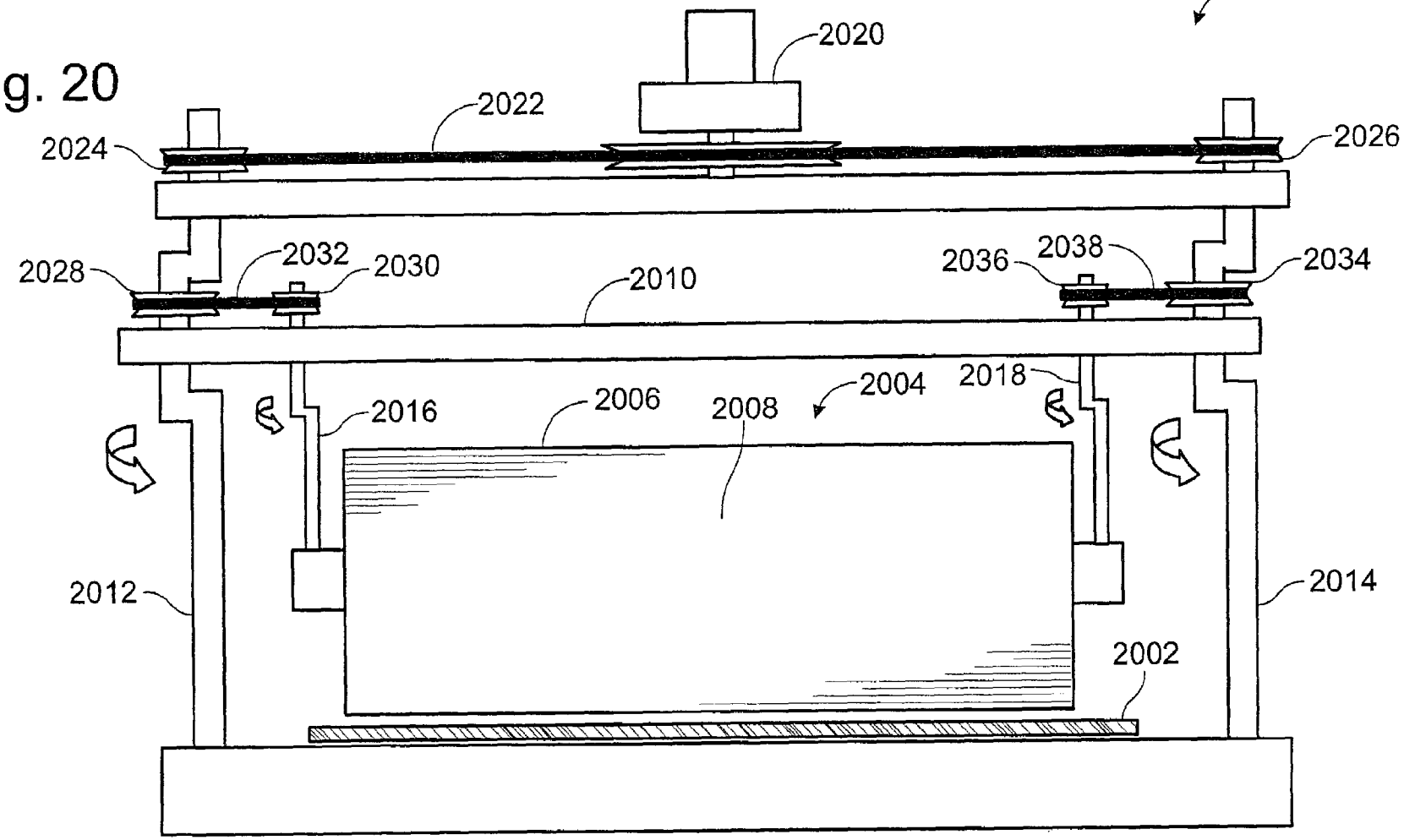
FIG. 20 is a schematic view of a sanding drum and a drive system capable of imparting two independent eccentric motions to the sanding drum.
Figure 21:
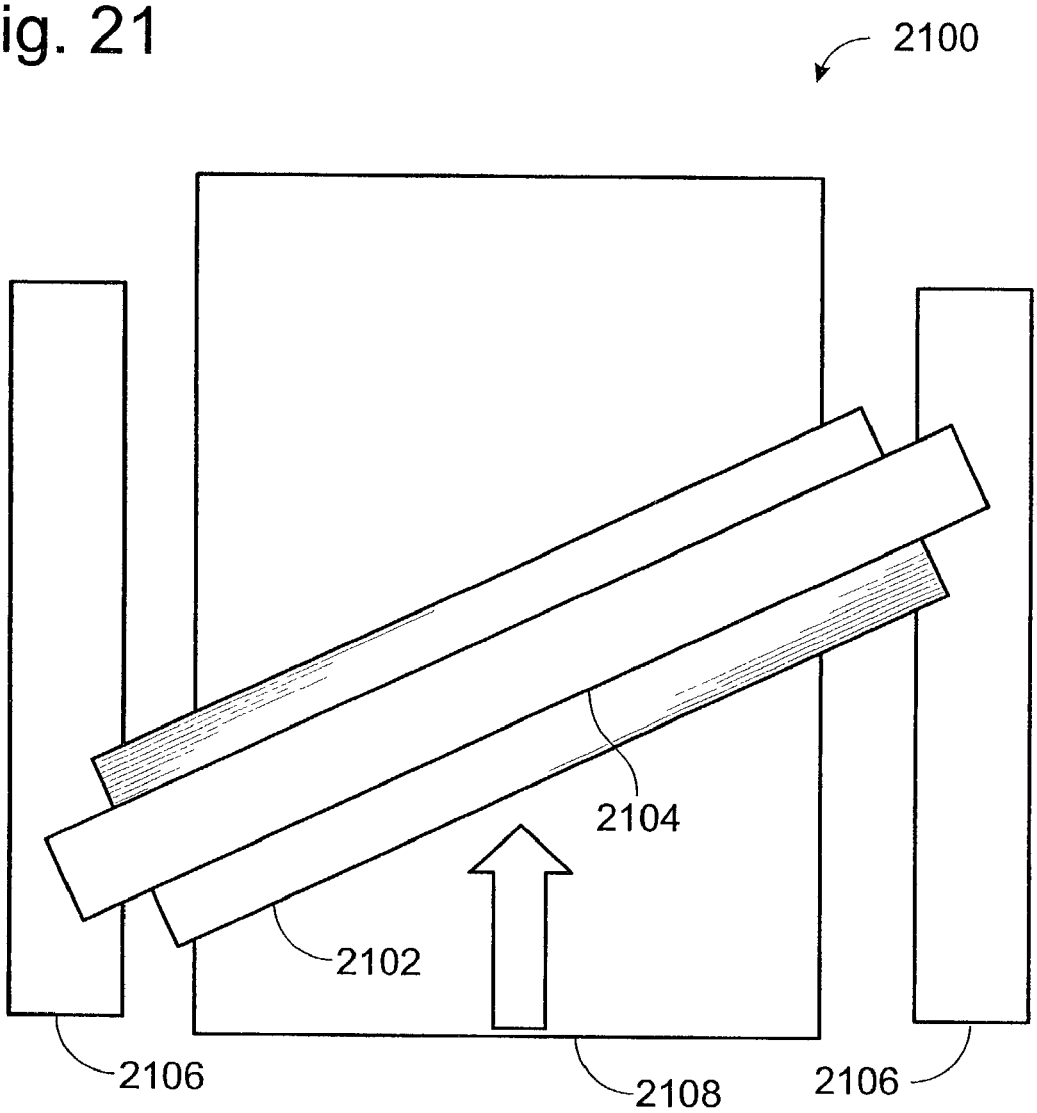
FIG. 21 is a schematic top view of a sanding drum oriented at an oblique angle to the conveyer assembly.

In another embodiment, as shown in FIG. 20, sanding machine 2000 includes a conveyer 2002 to convey product into the sanding machine, and a sanding assembly 2004 that includes a sanding drum 2006 having an abrasive drum surface 2008. Sanding drum 2006 may be rotated by a drive motor or other driving means (not shown). The sanding assembly depends from a brace 2010, that is connected to two drive shafts 2012 and 2014, where each drive shaft includes a step portion to impart an eccentric orbit to brace 2010 when rotated by a motor or other driving device (not shown). Sanding drum 2006 in turn depends from brace 2010 on eccentric drive shafts 2016 and 2018, which are configured to impart an additional and independent eccentric orbit to the sanding drum.

As shown in FIG. 20, motor 2020 is coupled to shafts 2012 and 2014 by a drive belt 2022 and pulleys 2024 and 2026. Drive shafts 2012 and 2014 are therefore rotated, and their rotary motion may then be directly or indirectly coupled to the motion of shafts 2016 and 2018, so that an independent drive system on brace 2010 to drive the second eccentric orbit is not required. The coupling may be any mechanically suitable coupling, including couplings that incorporate pulleys and V-belts, chain drives, or direct drive shafts, among others. Pulleys 2028 and 2030 are fixed to shafts 2012 and 2016, respectively. As the spacing between pulleys 2028 and 2030 is fixed, regardless of the motion of brace 2010, shafts 2012 and 2014 may be coupled by a belt 2032. Differential sizing of pulleys 2028 and 2030 permit the configuration of the coupling to include any desired gearing so as to alter the period of orbit of shaft 2014 relative to shaft 2012. Shafts 2014 and 2018 are similarly coupled via pulleys 2034 and 2036, and belt 2038.

Sanding machines capable of driving multiple eccentric orbits using a single motor, as described above and shown in FIG. 20, may utilize any of a variety of sanding assemblies, including the various sanding assemblies described herein. In particular, rather than the sanding drum shown in FIG. 20, brace 2010 may support one or more sanding assemblies that include multiple sanding heads (including eccentric sanding heads and non-eccentric sanding heads), sanding belts, platens, and sanding disks, among others.

Where the sanding assembly incorporates a sanding drum, as for the sanding assembly of FIG. 20, the drum may be suspended above the conveyer so that the axis of rotation of the drum is substantially orthogonal to the direction of motion of the conveyer. Alternatively, the sanding drum may be set at an oblique angle to a plane that is orthogonal to the direction of motion of the conveyer. Where the sanding drum is disposed at such an angle, the drum is preferably oriented so that the axis of rotation is at an angle between about 5 degrees and about 40 degrees from a plane orthogonal to the direction of motion of the conveyer. More typically, the angle of the sanding drum is about 20 to about 30 degrees from being orthogonal to the direction of motion of the conveyer. As shown in the simplified schematic of FIG. 21, a sanding machine 2100 includes a sanding drum 2102, depending from a brace 2104 that is coupled to the frame 2106 of the sanding machine. The sanding drum is oriented at an angle with respect to the movement of conveyer 2108. Drive systems have not been shown in FIG. 21 in order to more clearly demonstrate the orientation of the sanding assembly.

While multiple examples of sanding assemblies and sanding heads have been described, it is preferred that the sanding assembly impart an additional independent motion to the abrasive surface beyond the one or two combined orbital motions that are imparted to brace 70 by the sander of the invention.

Figure 4:
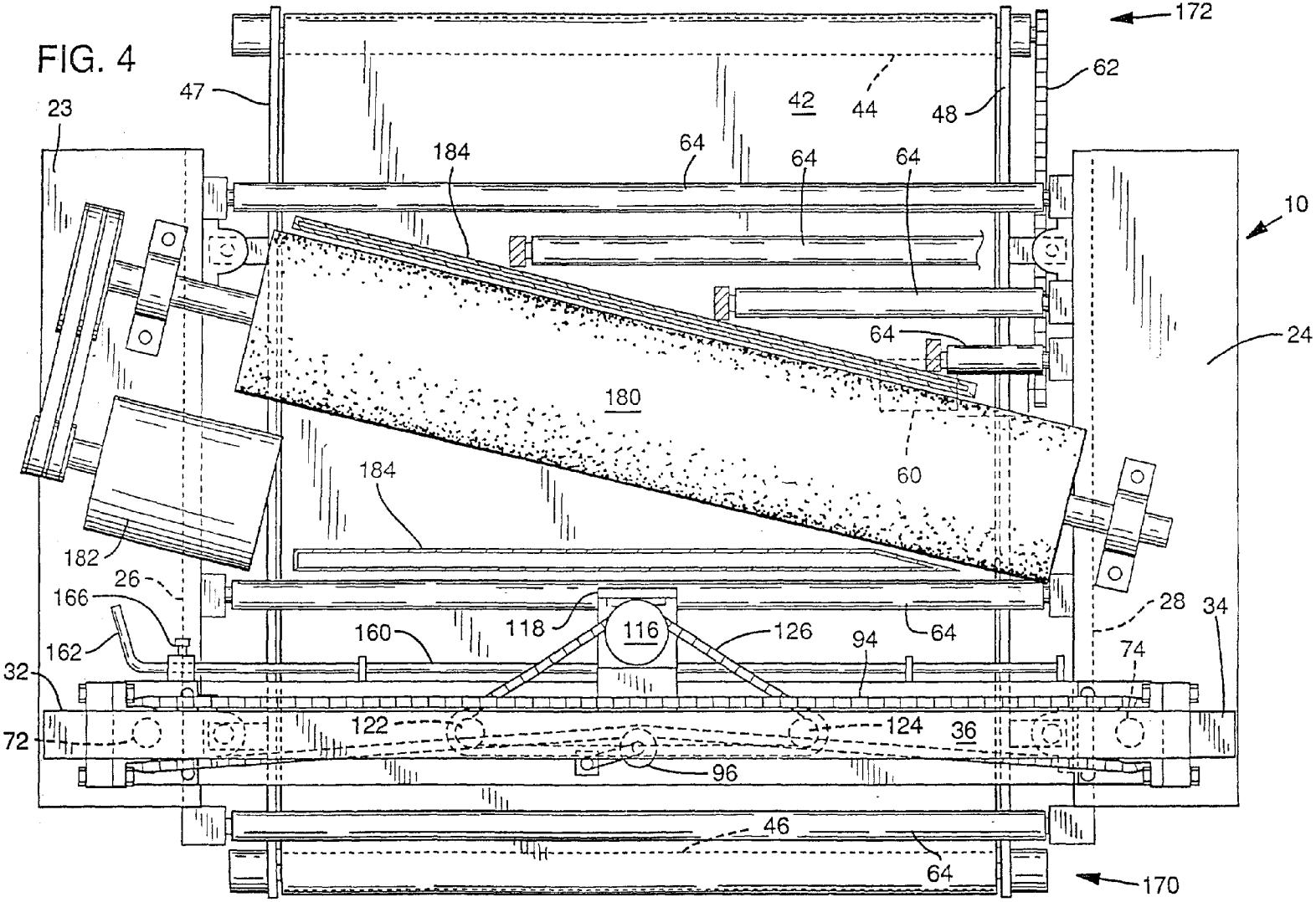
FIG. 4 is a top view of a sanding machine of the invention.

As seen in FIG. 4, the sander of the invention includes an upstream or front end 170 and a downstream or back end 172. Downstream from sanding assembly 100 is a rotating brush 180 positioned across conveyor belt 42. Brush 180 is supported by frame 16 and driven by a motor 182. Brush 180 removes any remaining streaks or scratches in products such as wood. Scratches removed by the brush are typically less than 0.0005-of-an-inch deep. Brush 180 is angled across conveyor belt 42 so that its bristles contact the wood product at an angle to any remaining cross-grain sanding patterns. Other embodiments of the invented sander may include two or more rotating brushes arranged at 90° relative to each other. Alternatively, the invented sander can be operated without any rotating brush.

A vacuum 184 (shown only in FIG. 4) may be positioned upstream and downstream from brush 180 to remove any dust resulting from the sanding. Vacuum 184 may be mounted to frame 16 and extend above conveyor belt 42.

OPERATION

In operation conveyor belt 42 is lowered and a product such as a wood panel is placed thereon. The belt is then raised until the desired height is obtained. At this point, the wood is positioned between belt 42 and the first pinch roller 64.

The conveyor belt is then powered so that it feeds or drives the wood product toward sanding assembly 100. The area immediately beneath sanding assembly 100 may be thought of as an abrading area. As can be seen in FIGS. 5 and 6, the wood product, such as product 174 in FIGS. 5 and 6, is fed under the sanding assembly 100 and abraded by abrasive 152. Abrasive 152 and sanding assembly 100 both move in at least one orbit, substantially eliminating all cross-grain sanding patterns.

The wood product is then fed past sanding assembly 100 where it contacts a second pinch roller. The wood product then contacts brush 180 and any remaining scratches or streaks are removed. The remaining pinch rollers 64 are supported by a brace (not shown) that extends over the conveyor belt. Those pinch rollers hold the wood product in position as it is conveyed under brush 180. The wood is finally emitted from the sander at downstream end 172.

The wood product is abraded or sanded by relative motion between the product and the abrasive. That motion may be imparted to the abrasive, to the product or to both. For example, the abrasive may move in one or more orbits and another motion, or the abrasive may move in one or more motions while the conveyor moves the product back and forth in yet another motion. Other relative motions are possible, particularly those applied by the sanding assembly as described above, and may be imparted by a variety of independent drive mechanisms as described above. Other possible drive mechanisms include vibration systems, spinning eccentric weights to cause motions, counter balanced weights, magnet driven systems, solenoids, pneumatic or air driven systems, systems to move the conveyor belt in motions in addition to the feed motion, etc. One motion may be motor driven, while a second motion may be random. Motors may be mounted on braces that move with the sanding assembly, or they may be mounted to a non-moveable support or portion of the sander.

Where the sanding assembly is compatible with such a system, the sanders as described above may also be equipped with abrasive indexing systems. Such systems feed new abrasive into position adjacent the sanding assembly, and optionally include a feed roll adjacent to one edge of the sanding assembly and a take-up roll adjacent an opposite edge of the sanding assembly. The indexing system is optionally manually powered, or powered by a motor to index the abrasive as desired.

INDUSTRIAL APPLICABILITY

The invented sander is applicable in any situation where sanding patterns need to be removed from products, including wood, stone, metal, or plastic products. The invented sander is especially applicable for finish sanding applications on wood products such as desk and table tops, panels, doors and cabinets.

Although the present invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances that fall within the scope of the appended claims.

I claim:

1. A sander, comprising a frame, a conveyer connected to the frame and configured to convey a product in a conveying direction through the sander for sanding, a first drive mechanism that supports a brace and that causes the brace to move in a first nonlinear motion, and a rotatable sanding drum having an abrasive surface, where the sanding drum is supported by the brace adjacent to the conveyer.

2. The sander of claim 1, further comprising a second drive mechanism that causes the sanding drum to move in a second nonlinear motion that is independent of the first nonlinear motion.

3. A sander, comprising a frame, a conveyer connected to the frame and configured to convey a product in a conveying direction through the sander for sanding, a first drive mechanism that supports a brace and that causes the brace to move in a first nonlinear motion, a sanding drum having an abrasive surface, where the sanding drum is supported by the brace adjacent to the conveyer, and a second drive mechanism that causes the sanding drum to move in a second nonlinear motion that is independent of the first nonlinear motion.

4. The sander of claim 3, where the sanding drum is supported by the brace at an oblique angle relative to the conveyer.

5. The sander of claim 4, where the axis of rotation of the sanding drum is at an angle of between about 5 degrees and about 40 degrees from a plane orthogonal to the conveying direction.

6. The sander of claim 4, where the axis of rotation of the sanding drum is at an angle of between about 20 degrees and about 30 degrees from a plane orthogonal to the conveying direction.

7. The sander of claim 3, where the first and second nonlinear motions are eccentric orbits.

8. The sander of claim 3, where the second drive mechanism is coupled to the first drive mechanism.

9. The sander of claim 3, further comprising a rotating brush configured to abrade and polish the product after it has been sanded by the abrasive surface.

* * * * *